US007068967B2

(12) United States Patent
Nakagawa

(10) Patent No.: US 7,068,967 B2
(45) Date of Patent: Jun. 27, 2006

(54) DEVELOPING APPARATUS WITH SEPARABLE MULTIPLE DEVELOPER LAYERS AND IMAGE FORMING APPARATUS INCORPORATING SAME

(75) Inventor: Ken Nakagawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 10/765,855

(22) Filed: Jan. 29, 2004

(65) Prior Publication Data

US 2004/0247346 A1 Dec. 9, 2004

(30) Foreign Application Priority Data

Jan. 31, 2003 (JP) ..... 2003-024168
Dec. 3, 2003 (JP) ..... 2003-404934

(51) Int. Cl.
*G03G 15/01* (2006.01)
*G03G 15/08* (2006.01)

(52) U.S. Cl. ..... 399/232; 399/223; 399/284; 399/299

(58) Field of Classification Search ..... 399/223, 399/231, 232, 274, 284, 298, 299, 302; 347/115
See application file for complete search history.

(56) References Cited

U.S. PATENT DOCUMENTS 4,264,185 A * 4/1981 Ohta ..... 399/232
4,562,129 A 12/1985 Tanaka et al. ..... 430/42
4,947,201 A * 8/1990 Niv et al. ..... 399/233
5,373,353 A * 12/1994 Fukasawa ..... 399/284
5,453,822 A * 9/1995 Anzai et al. ..... 399/299
5,587,551 A * 12/1996 Ikegawa et al. ..... 399/284
5,752,146 A * 5/1998 Sato ..... 399/284
6,456,813 B1 * 9/2002 Sato ..... 399/284
2003/0026629 A1 2/2003 Kawamura et al. ..... 399/281

FOREIGN PATENT DOCUMENTS

| | | |
|---|---|---|
| JP | 55-43533 | 3/1980 |
| JP | 59-58442 | 4/1984 |
| JP | 60-131554 | 7/1985 |
| JP | 63-23175 | 1/1988 |
| JP | 2-37595 | 8/1990 |
| JP | 5-80671 | 9/1993 |

* cited by examiner

*Primary Examiner*—Sandra L. Brase
(74) *Attorney, Agent, or Firm*—Fitzpatrick, Cella, Harper & Scinto

(57) ABSTRACT

A developing apparatus including a developer container which contains a first developer having a first charging polarity and a second developer having a second charging polarity opposite to the first charging polarity, a developer bearing member which bears the first and the second developers, a layer forming device which forms a first layer substantially composed of the first developer on the developer bearing member and forms a second layer composed of the first and the second developers on the first layer, a separating member which is provided downstream of the layer forming device and upstream of a developing position in a developer bearing and conveying direction of the developer bearing member to separate the second layer from the developer bearing member, whereby plural kinds of developers can be selectively supplied for a development.

31 Claims, 8 Drawing Sheets

DEVELOPING APPARATUS WITH SEPARABLE MULTIPLE DEVELOPER LAYERS AND IMAGE FORMING APPARATUS INCORPORATING SAME

BACKGROUND OF THE INVENTION

1. Field of the Invention

The present invention relates to an image forming apparatus, which uses an electrophotographic system or an electrostatic recording system, such as a printer, a facsimile apparatus, or a copying machine, and a developing apparatus which is preferably used in the image forming apparatus. More specifically, the present invention relates to a developing apparatus and an image forming apparatus which can perform development by selectively using a single developer out of plural kinds of developers with one developer carrying member.

2. Related Background Art

Conventionally, for example, in a typical arrangement for a color image forming apparatus using an electrophotographic system, developing apparatuses are provided in the same number as kinds (number of colors) of developers (toners) to be used, and electrostatic latent images corresponding to the respective kinds of developer (toners of the respective colors) are developed, whereby a developer image of desired colors or desired number of colors is obtained. In particular, in order to reproduce a full-color image, an image forming apparatus using developers of four different colors, namely, cyan, magenta, yellow and black, has been put to practical use. In addition, in a single color image forming apparatus, a method of using plural kinds of developers having different concentrations to enhance gradation property in representing the tone has also been proposed.

Such an image forming apparatus, which uses plural kinds of developers, represented by a color image forming apparatus requires developing apparatuses of respective colors. Thus, the image forming apparatus has problems in that, for example, a volume of the entire apparatus is increased, a large number of control high-voltage power supplies are required, control is complicated, a driving torque is increased due to an increase in the number of movable components, and power consumption is increased following the increase in the driving torque.

In order to cope with these problems resulted from the large number of developing apparatuses, there has been devised a developing apparatus which selectively furnishes plural kinds of developers for development with one developing apparatus.

As a method of separating the plural kinds of developers in such a developing apparatus, in particular, there have been proposed many systems for mixing two different kinds of developers with positive and negative charging polarities to develop two kinds of developer images with one developing apparatus (hereinafter referred to as "negative/positive mixing systems") for their readiness of separating colors. Among the negative/positive mixing systems, the following systems are noted:

(1) a system for mixing two kinds of magnetic single-component developers containing a magnetic substance as a developer as disclosed in Japanese Patent Publication No. H5-80671;

(2) a magnetic/nonmagnetic mixing system for containing a magnetic substance in one developer and making the other developer nonmagnetic as disclosed in Japanese Patent Application Laid-Open No. S59-58442;

(3) a system for mixing two kinds of non-magnetic single-component developers as disclosed in Japanese Patent Application Laid-Open No. S55-43533; and (4) a system for mixing a magnetic carrier in a mixed developer consisting of toners of both positive and negative polarities as disclosed in Japanese Patent Application Laid-Open Nos. S60-131554 and S63-23175.

However, in the above-described systems using the magnetic developer, it is difficult to manufacture developers having high chroma of colors other than black (hereinafter referred to as "color toners") under the present situation because it is difficult to manufacture a transparent magnetic substance, and a color tint of a magnetic substance cannot be extinguished completely. In addition, when using color toners that use colored magnetic substances for full color development, there is a problem of a narrow range of color reproduction. Thus, the magnetic substances cannot be used for color toners under the present situation. On the other hand, the system using the magnetic carriers has problems of the complicated apparatus because, for example, a magnet for restricting the carrier is required, a sensor for measuring a mixing ratio of the carrier and the toner is required, or control means for controlling the mixing ratio is required.

Therefore, a developing apparatus, which can selectively furnish plural kinds of developers for development using a non-magnetic single-component developer as a developer, is desired.

As such a developing apparatus, as disclosed in Japanese Patent Application Laid-Open No. S55-43533, there has been proposed a method of injecting charge to a toner with a doctor blade using plural non-magnetic single-component developers (toners) having different charging orders. With this method, rather than selectively coating only one kind of toner among toners on a developing roller to be supplied to a developing part, the toners on the developing roller are supplied to the developing part in a mixed state and selectively furnished for development depending on a difference of charging amounts of the respective toners.

However, sufficient selectivity cannot be obtained by the method using a difference of charging amounts and causes color mixture in a developed image. An image failure called "muddled color," in which a toner of a color which should not originally be supplied is supplied to an image part on an object to be developed, tends to occur. In addition, since a positively charged toner passes through the doctor blade to be furnished for development, an image failure called "fog," in which the toner which should not originally be supplied is supplied to a non-image part on the object to be developed, tends to occur.

In order to cope with this problem, Japanese Patent Publication No. H2-37595 discloses a method of providing an electric field between a supply roller for supplying a toner onto a developing roller and the developing roller and selectively supplying the toner to the developing toner to cause the developing roller to bear (carry) the toner.

However, as described later, in the developing apparatus disclosed in Japanese Patent. Publication No. H2-37595, it is unavoidable to bring the supply roller and the developing roller into a non-contact state due to a problem of color mixing or the like. In addition, even in that case, if a toner as a non-magnetic single-component developer is used, since a mixed developer on the supply roller is charged only by a regulating member brought into abutment against the supply roller, a distribution of charging amounts is broad, the toner does not fly from the supply roller to the developing roller uniformly, possibly causing unevenness on the developing roller.

Consequently, Japanese Patent Publication No. H2-37595 recommends an arrangement in which a supply roller containing a magnetic developer and a magnet is used to cause the developer to fly from the supply roller to the developing roller uniformly under an alternating electric field.

SUMMARY OF THE INVENTION

It is an object of the present invention to provide a developing apparatus and an image forming apparatus which can selectively furnish plural kinds of developers for development.

It is another object of the present invention to provide a developing apparatus and an image forming apparatus which can prevent color mixing and prevent occurrence of an image failure such as muddled color, color fog, or unevenness of concentration, and improve a degree of freedom of apparatus design.

It is another object of the present invention to provide a developing apparatus and an image forming apparatus which makes it possible to simplify the image forming apparatus by reducing the number of developing apparatuses from four as required conventionally to two.

DESCRIPTION OF THE PREFERRED EMBODIMENTS

A developing apparatus and an image forming apparatus in accordance with the present invention will be hereinafter described more in detail with reference to the accompanying drawings.

First Embodiment

Figure 1:
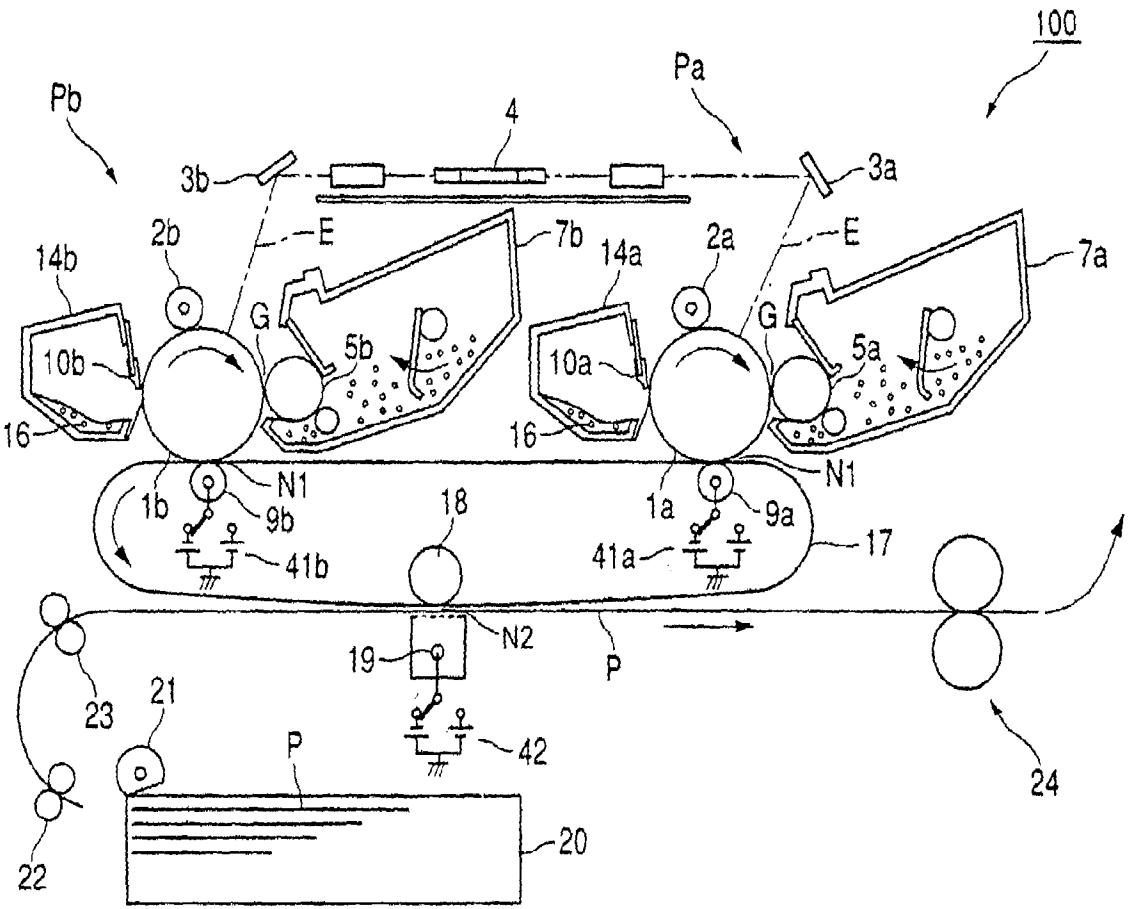
FIG. 1 is a schematic sectional view of an embodiment of an image forming apparatus in accordance with the present invention.

FIG. 1 shows a schematic sectional view of an embodiment of an image forming apparatus in accordance with the present invention.

First, an overall structure of the image forming apparatus of this embodiment will be described. An image-forming apparatus 100 of this embodiment is a laser beam printer which can form an image on a recording material such as recording paper, an OHP sheet, or cloth using an electrophotographic system according to image information from an external host apparatus such as a personal computer, an original reading apparatus, or the like connected to an apparatus main body of the image forming apparatus so as to be able to communicate with each other. In particular, the image forming apparatus 100 of this embodiment is an image forming apparatus of an intermediate transferring system which is capable of forming a full-color image using developers of four colors of yellow (Y), magenta (M), cyan (C) and black (K).

The image forming apparatus 100 of this embodiment includes a first station Pa and a second station Pb as image forming parts. The image forming apparatus 100 transfers developer images (toner images), which are formed on drum type electrophotographic photosensitive members (hereinafter referred to as "photosensitive drums") 1*a* and 1*b* serving as image bearing members provided in the respective stations Pa and Pb, onto an intermediate transferring belt 17 serving as an intermediate transferring member, composites the developer images thereon, and further transfers the composite toner image onto a recording material P to obtain a recorded image. In this embodiment, two developing apparatuses 7*a* and 7*b* serving as developing means are arranged. The respective developing apparatuses 7*a* and 7*b* supply developers (toners) of two colors, whereby developers of a total of four colors are superimposed one on top of another and image formation is performed.

This embodiment will be hereinafter described more in detail. Here, since constitutions and image forming operations of the respective stations Pa and Pb are the same except kinds of developers, unless specifically required to be distinguished, the stations Pa and Pb will be described generally without subscripts "a" and "b", which are given to the stations so as to indicate that the stations are components belonging to respective image forming parts Pa and Pb.

A photosensitive drum 1 is driven to rotate in a direction indicated by arrow in FIG. 1. A charging roller 2 serving as charging means is provided around the photosensitive drum 1. The charging roller 2 receives power supply from a charging high-voltage power supply (not shown) to charge the surface of the rotating photosensitive drum 1 uniformly to a fixed potential. A laser beam E emitted from a laser scanner 4 serving as exposing means is reflected on a reflection mirror 3 and irradiated on the charged surface of the photosensitive drum 1. Consequently, an electrostatic potential varies in a part subjected to exposure E on the photosensitive drum 1, and an electrostatic latent image according to desired image information, which is subjected to color separation, is formed on the photosensitive drum 1. Subsequently, in a part where the developing apparatus 7 and the photosensitive drum 1 are opposed to each other (developing part) G, the electrostatic latent image is developed by toners of desired colors and visualized as a toner image.

Figure 10:
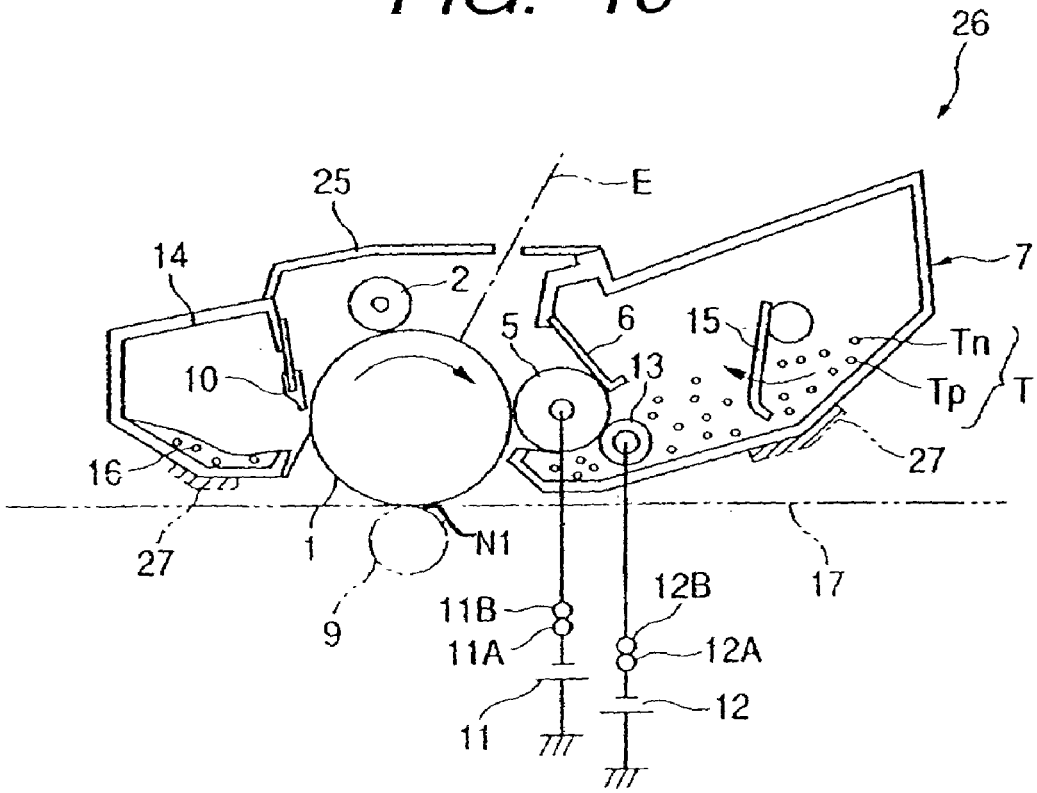
FIG. 10 is a schematic sectional view of an embodiment of a process cartridge in accordance with the present invention.

With reference to FIG. 10, the toner image formed on the photosensitive drum 1 is transferred onto an intermediate transferring belt 17 in a primary transferring part N1 where a primary transferring roller 9 serving as primary transferring means comes into abutment against the photosensitive drum 1 via the intermediate transferring belt 17. In the primary transferring part N1, a transferring bias of desired polarity and potential is applied to the primary transferring roller 9.

A residual toner remaining on the photosensitive drum 1 after a primary transferring process is removed by a cleaning blade 10 serving as cleaning means and contained in a cleaner container 14 as a waste toner 16. The photosensitive drum 1 cleaned in this way is repeated furnished for the next image forming process.

Next, a method of forming a full-color image with this image forming apparatus will be described.

In the developing apparatus 7*a* provided in the first station Pa shown on the right side in FIG. 1, a yellow developer (negatively charged toner) serving as a first developer of a negative charging property (first charging polarity) and a black developer (positively charged toner) serving as a second developer with a positive charging property (second charging polarity) are contained. In the developing apparatus 7*b* provided in the second station Pb shown on the left side in FIG. 1, a cyan developer (positively charged toner) serving as a first developer with a positive charging property and a magenta developer (negatively charged toner) serving as a second developer of a negative charging property are contained.

First, a cyan toner image and a black toner image are formed in the respective photosensitive drums 1*a* and 1*b* with the cyan toner (positively charged toner) and the black toner (positively charged toner) according to a regular developing method well known to those skilled in the art (here, moving a developer to an unexposed part of an image bearing member charged in a polarity opposite to a charging polarity of the developer (negative polarity) used in a conventional analog copying machine or the like. Then, the cyan toner image and the black toner image are transferred onto the intermediate transferring belt 17 by primary transferring rollers 9*a* and 9*b*, to which a bias of the negative polarity is applied from the primary transferring bias power supplies 41*a* and 41*b*, and superimposed one on top of the other on the intermediate transferring belt 17 at a primary transferring part N1.

The toner image, which is charged in the positive polarity, on the intermediate transferring belt 17 reaches a portion, where a corona charging part 19 serving as developer charging means and the intermediate transferring belt 17 are opposed to each other, in accordance with a circulating movement (rotation) of the intermediate transferring belt 17, and is charged in the negative polarity by the corona charging part 19, to which a bias of the negative polarity is applied from a corona charging part bias power supply 42, and changes to a toner image charged in the negative polarity later.

Thereafter, latent image formation is switched to that for reversal development, and developing colors of the developing apparatuses 7*a* and 7*b* are switched in good timing. Then, in synchronization with the movement of the toner image on the intermediate transfer belt 17, a magenta toner image and a yellow toner image are formed on both the photosensitive drums 1*a* and 1*b* by the magenta toner (negatively charged toner) and the yellow toner (negatively charged toner) according to reversal development (here, transferring a developer to an exposed part of an image bearing member charged in the same polarity (negative polarity) as the charging polarity of the developer), respectively. Then, the magenta toner image and the yellow toner image are transferred onto the intermediate transferring belt 17 by the primary transferring rollers 9*a* and 9*b*, to which a bias of the positive polarity is applied from the primary transferring bias power supplies 41*a* and 41*b*. In this way, a full-color superimposed image of four colors is formed on the intermediate transfer belt 17.

The recording material P is conveyed in timing with the movement of the full-color toner image, and the full-color image is secondarily transferred onto the recording material P in a part where a conveying roller 18 disposed inside the intermediate transfer belt 17 and the corona charging part 19 functioning as secondary transferring means are opposed to each other (secondary transferring part) N2. At this point, a bias of a polarity opposite to the toner on the intermediate transferring belt 17 (positive polarity) is applied to the corona charging part 19 from the corona charging part bias power supply 42. In this way, the corona charging part 19 functions both as charging means, which adjusts a charging polarity of the toner on the intermediate transferring belt 17, and as transferring means, which secondarily transfers the toner image from the intermediate transferring belt 17 onto the recording material P. The recording material P is conveyed from a cassette 20 serving as a recording material containing part to the secondary transferring part N2 by conveying means such as a separating roller 21, a conveying roller pair 22, and a registration roller pair 23.

The recording material P having the full-color toner image transferred thereon is further conveyed to a roller fixing device 24 serving as fixing means, and the full-color toner image is fixed on the recording material P by the roller fixing device 24. Thereafter, the recording material P having the image fixed thereon is discharged from the image forming apparatus 100.

Conventionally, four developing apparatuses are required for forming a toner image of four colors. However, it becomes possible to form a full-color image of four colors with two developing apparatuses and to reduce a size of the image forming apparatus by using the developing apparatus in accordance with the present invention, which has a high color separation efficiency. Next, the developing apparatus 7 of this embodiment, which is used for consecutive two-color development as described above, will be described.

Figure 2:
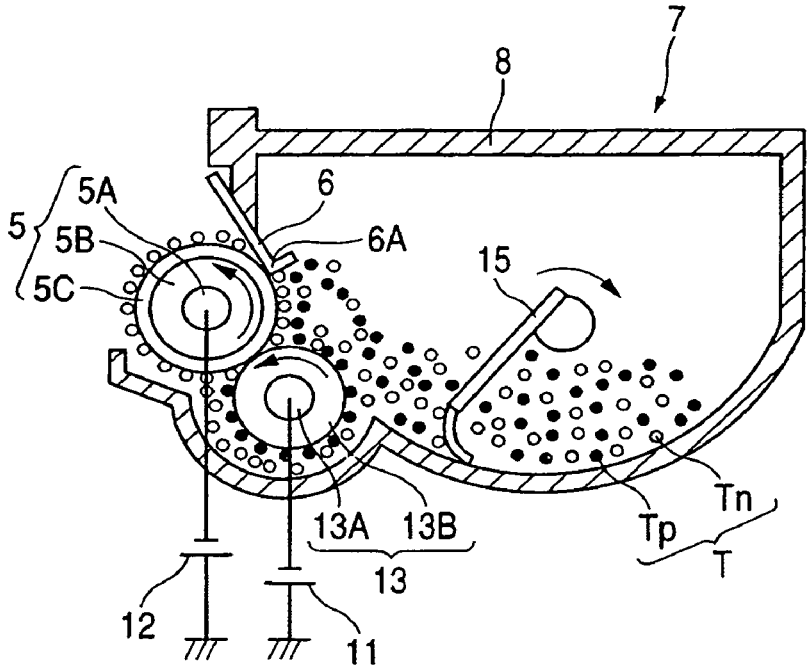
FIG. 2 is a schematic sectional view of an embodiment of a developing apparatus in accordance with the present invention.

FIG. 2 is a schematic sectional view of the developing apparatus 7 of this embodiment. In this embodiment, the developing apparatus 7 includes a developer container 8 containing a toner which is an insulating non-magnetic single-component developer. The toner is formed by mixing a positively charged toner Tp (black circle in the figure) serving as a first developer and a negatively charged toner Tn (white circle in the figure) serving as a second developer. The positively charged toner Tp and the negatively charged toner Tn are colored particles containing different coloring agents. The mixture of the positively charged toner Tp and the negatively charged toner Tn is generally referred to as a mixed developer (mixed toner) T.

A developing roller 5 serving as a developer carrying member is disposed rotatably so as to be located in an opening of the developer container 8 opposed to the photosensitive drum 1, which is an object to be developed, and to be partly exposed from the developer container 8. The developing roller 5 carries out a role of supplying a toner held on a surface thereof to the object to be developed such as the photosensitive drum 1, which is provided outside the developer container 8, in accordance with rotation of the developing roller 5. A developing bias power supply 12 serving as voltage applying means is connected to the developing roller 5. A bias voltage to be applied to the developing roller 5 from the developing bias power supply 12 is adjusted such that the toner on the developing roller 5 is peeled off by an electric field, which is provided between the developing roller 5 and the photosensitive drum 1, to move to the photosensitive drum 1.

A removing/supply roller 13 of a rotary body serving as developer layer forming means is brought into abutment against the developing roller 5. The removing/supply roller 13 is driven to rotate in a direction of arrow in the figure, and a rotation speed of the removing/supply roller 13 is set to be different from that of the developing roller 5. In this embodiment, the developing roller 5 and the removing/supply roller 13 are rotated at different peripheral speeds in the same direction such that surface moving directions thereof are opposite from each other (counter directions) in the abutting part. As described in detail later, as the removing/supply roller 13, polyurethane foam having conductivity processed in a roller shape as a foamed elastic layer (sponge layer) 13B on a cored bar 13A, or foamed rubber obtained by foaming and cross-linking rubber such as EPDM or silicone scattered with a conductive agent such as carbon black, titanium oxide, or tin oxide formed in a roller shape on the cored bar 13A is used. Alternatively, for example, there is a method of processing ordinary polyurethane foam, to which conductivity is not given, in a roller shape, and adhering a conductive material such as carbon to the surface of the polyurethane foam with rubber latex as a binder to form a conductive foamed roller. As a foamed cell, one with a diameter of about 10 to 1,000 μm can be preferably used. In order to contain the mixed developer T so as to be freely taken out, it is advisable to set the diameter of the foamed cell to be at least larger than a maximum particle diameter of the mixed developer T.

A supply bias power supply 11 serving as voltage applying means is connected to the removing/supply roller 13. A voltage of the supply bias power supply 11 is variable such that a polarity of a potential difference between the removing/supply roller 13 and the developing roller 5 can be switched. In other words, as described later in detail, the supply bias power supply 11 is adapted such that a potential difference, with which one of the positively charged toner Tp and the negatively charged toner Tn moves to the developing roller 5 (therefore, the other moves to the removing/supply roller 13), can be switched and provided. By switching the polarity of the potential difference, a kind of a toner to be furnished for development can be changed, and plural kinds of toners can be supplied to the photosensitive drum 1 serving as an object of development from one developing roller 5.

In addition, in order to form the toner on the surface layer of the developing roller 5 in a uniform thin layer, a regulating blade 6 serving as separating means (developer layer thickness regulating member) is brought into abutment against the developing roller 5. As described later in detail, as the regulating blade 6, a stainless thin plate with a thickness of 10 to several hundreds μm can be used preferably. The regulating blade 6 is fixed to the developer container (toner container) 8 so as to come into abutment against the developing roller 5 with a relatively equal abutting pressure. Further, in this embodiment, the regulating blade 6 is brought into abutment against the developing roller 5 such that a free end thereof is located on the upstream side in the rotating direction of the developing roller 5. Moreover, as described later in detail, in this embodiment, a curved part (inflected part) 6A, which is curved to a side opposite to the surface of the developing roller 5, is provided in the vicinity of the tip on the free end side of the regulating blade 6. A developer regulating part of the regulating blade 6 is provided on the downstream side of the removing/supply roller 13 and on the upstream side of the developing part in the rotating direction of the developing roller 5.

A plate-like agitating member 15 is further provided in the developer container 8. As the agitating member 15, a rotation shaft of resin attached with a plate-like member having flexibility such as Mylar can be preferably used. The agitating member 15 rotates in a direction of arrow in the figure and carries the mixed developer T contained in the developer container 8 toward the developing roller 5 and the removing/supply roller 13 to supply the mixed developer T thereto. The flexible plate-like member such as Mylar constituting the agitating member 15 moves while rubbing the bottom of the developer container 8 and bending and conveys the mixed developer T in the developer container 8 while agitating the mixed developer T such that it does not accumulate on the bottom of the developer container 8.

Figure 3:
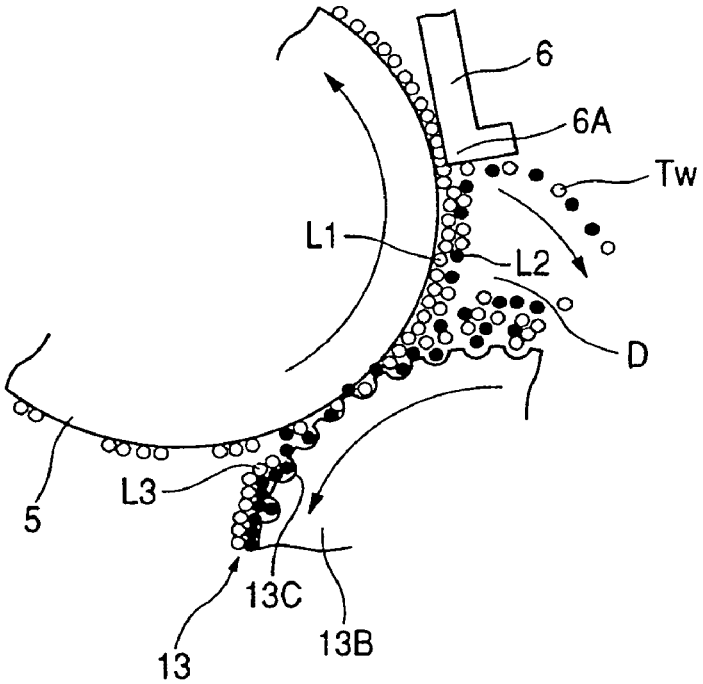
FIG. 3 is a schematic diagram showing the vicinity of a developing roller, a removing/supply roller, and a regulating blade in the developing apparatus of FIG. 2 in an enlarged state.

FIG. 3 shows the enlarged vicinity of the abutting part between the developing roller 5 and the removing/supply roller 13 and the regulating blade 6 of the developing apparatus 7 of FIG. 2. An operation of the developing apparatus 7 of this embodiment will be described more in detail with reference to FIG. 3.

For example, in the case in which the negatively charged toner Tn is supplied to the developing roller 5 (at the time of execution of a developing operation with the negatively charged toner Tn), "potential of the removing/supply roller 13—potential of the developing roller 5" is found as a negative potential (e.g., the developing roller (developing bias): −400 V, the removing/supply roller (supply bias): −800 V).

Here, it is assumed that a polarity of a potential difference between a potential of the removing/supply roller 13 and a potential of the developing roller 5 is "negative" in the case in which "potential of the removing/supply roller 13 potential of the developing roller 5" has a negative polarity and, conversely, the polarity is "positive" in the case in which "potential of the removing/supply roller 13—potential of the developing roller 5" has a positive polarity. Therefore, a layer of a negatively charged toner is mainly formed on the developing roller in the case in which a "negative potential difference" is formed, and a layer of a positively charged toner is mainly formed on the developing roller in the case in which a "positive potential difference" is formed.

The mixed developer T, which is contained in a cell 13C of the most outer layer (sponge layer) 13B of the removing/supply roller 13, is carried to the abutting part between the developing roller 5 and the removing/supply roller 13 by the rotation of the removing/supply roller 13 in the direction of arrow in the figure. The positively charged toner Tp is triboelectrically charged to positive and the negatively charged toner Tn is triboelectrically charged to negative by rubbing with the developing roller 5. In addition, both the positive and negative toners Tp and Tn adhere to each other to form an aggregate and, from a broad viewpoint, an aggregate of toners with less charging amount is subjected to mechanical shear (separating force) in the rubbing part between the developing roller 5 and the removing/supply roller 13 and separated.

Then, the toner charged in the negative polarity is moved to the developing roller 5 side and the toner charged in the positive polarity is moved to the removing/supply roller 13 side by a force of an electric field formed by the "negative potential difference" as described above acting on the abutting part between the developing roller 5 and the removing/supply roller 13 (first developer separation process).

Here, simultaneously with a first toner layer L1 consisting of a single kind of toner being formed on the developing roller 5, the removing/supply roller 13 removes a residual toner, which has not been furnished for development outside the developer container 8 and remained on the developing roller 5, from the developing roller 5.

In the cell 13C on the downstream side in the rotating direction of the removing/supply roller 13, which has undergone the rubbing between the developing roller 5 and the removing/supply roller 13 as the first separation process, a third toner layer L3 containing a large quantity of the positively charged toner Tp is formed, and a large quantity of the residual toner removed from the developing roller 5 is held in a surface layer of the removing/supply roller 13. The third toner layer L3 replaces the mixed developer T around the third toner layer L3 according to the rotation of the removing/supply roller 13 and contains the mixed developer T in the cell 13C to prepare for the next supply.

It is important that the surface layer of the removing/supply roller 13 can hold a large amount of toner and has a structure in which the held toner can move relatively freely. In order to allow the toner to be separated to the developing roller 5 side and the removing/supply roller 13 side by an electric field, a space in which the toners on both the sides can move and a space in which a sufficient amount of toner can be contained after the separation are required. A sponge roller having innumerable vacancies formed in an outermost layer thereof is suitable for the surface layer. In addition, when a polarity of a potential difference is reversed, a type of the toner is switched, and the positively charged toner Tp is supplied to the developing roller 5, since the positively charged toner Tp contained in the cell 13C in a large amount is instantly supplied to the developing roller 5, there is also an advantage that a type of the toner can be changed at high speed.

As shown in FIG. 3, when the first toner layer L1 consisting of the negatively charged toner Tn is formed on the developing roller 5 as described above, a second toner layer L2 consisting of both the positive and negative toners Tp and Tn are formed on the first toner layer L1 on the upstream side of the regulating blade 6 in the rotating direction of the developing roller 5. As a residual toner consisting of both the positive and negative toners Tp and Tn accumulates in an area D on the upstream side in the rotating direction of the removing/supply roller 13 in the rubbing part, the second toner layer L2 is formed, and the residual toner reservoir D and the first toner layer L1 come into contact with each other-by bringing the removing/supply roller 13 having a large amount of held toner and the developing roller 5 having a relatively small amount of held toner into abutment with each other with a peripheral speed difference.

In this way, the removing/supply-roller 13 mainly works as first separating means which selectively forms a toner having one charging polarity on the developing roller 5. More specifically, the removing/supply roller 13 works as multi-layer forming means which forms the lower layer (first toner layer) L1 consisting of substantially one kind of toner on the developing roller 5 from plural kinds of toners having different charging polarities and forms the residual toner reservoir D to thereby form the upper layer (second toner layer) L2 consisting of plural kinds of toners on the first toner layer L1.

The second toner layer L2 mainly adheres mechanically. Compared with an electric adhesive force due to a reflection force of the developing roller 5 and the first toner layer L1, an adhesive force of the first toner layer L1 and the second toner layer L2 is weak. Consequently, only the second toner layer L2 having the relatively weak adhesive force is scraped off by the regulating blade 6 and changes to a toner flow Tw, which is schematically shown in FIG. 3, to be carried by the removing/supply roller 13 again (second developer separation process).

When the second toner layer L2 is exfoliated from the first toner layer L1, since the second toner layer L2 is exfoliated against an electric adsorptive force of the negatively charged toner Tn in the first toner layer L1 and the positively charged toner Tp contained in the second toner layer L2, which is weak though, there is also an effect that the first toner layer L1 is exfoliated and charged, and a charging amount is stabilized.

Only the first toner layer L1, in which almost the entire amount of toner is the negatively charged toner Tn, is made uniform and selectively moved to the outside of the developer container 8 and furnished for development according to the second developer separation process by the regulating blade 6 serving as separating means.

In this way, the regulating blade 6 works as second separating means (layer regulating member) which selectively passes the first toner layer L1 formed on the developing roller 5 by the removing/supply roller 13. More specifically, the regulating blade 6 allows the passage of the first toner layer L1 following the movement of the surface of the developing roller 5 and also works as a single layer regulating member which regulates passage of the second toner layer L2.

On the other hand, when the polarity of the potential difference between the removing/supply roller 13 and the developing roller 5 is switched, a third layer is formed on the developing roller 5, and a fourth layer is formed on the third layer. The third layer is substantially a layer of the positively charged toner and the fourth layer is a layer in which the positively charged toner and the negatively charged toner are mixed. The fourth layer is separated from the developing roller 5 by the regulating blade 6, and a developer layer substantially consisting of only the third layer is carried to the developing part by the developing roller 5.

The regulating blade 6 is required to be set so as to pass only the first toner layer L1. If the regulating blade passes the second toner layer L2 as well, colors of toners to be furnished for development are mixed. Then, due to the positively charged toner Tp mixed on the developing roller 5, "color fog" in which the positively charged toner Tp adheres to a white base part occurs. In addition, since adhesion of the negatively charged toner Tn to a normal print part is prevented, local unevenness of concentration occurs. Thus, it is undesirable to pass the second toner layer L2.

Incidentally, as described above, Japanese Patent Publication No. H2-37595 discloses the method of providing an electric field between a supply roller for supplying a toner onto a developing roller and the developing roller and selectively supplying the toner to the developing roller to cause the developing roller to carry the toner. In the method disclosed in Japanese Patent Publication No. H2-37595, it is necessary that a first developer separation part is provided in a developer container such that a mixed developer does not come into contact with the developing roller after being subjected to coating of a single developer in order to prevent color mixing. Consequently, there is limitation in arranging the supply roller on the lower side in a direction of the center of gravity, and it is necessary to adjust an amount of toner or set a toner capacity such that the surface of the toner does not become excessively high in order to prevent the entire supply roller from being immersed in the toner.

On the other hand, according to this embodiment, since the second toner layer L2 consisting of the mixed developer T is provided on the first toner layer L1 consisting of a single kind of toner, and the regulating blade 6 serving as single layer regulating means, which passes only the first toner layer L1, an excellent developer separating performance can be obtained regardless of an amount of the mixed developer T in the developer container 8. In addition, unevenness of concentration can be prevented by leveling the toner layer consisting of the single kind of toner.

In this embodiment, since the developing roller 5 may be immersed in the mixed developer T entirely or partly, there is an advantage that a degree of freedom of arrangement of the respective rollers (the developing roller 5 and the removing/supply roller 13) with respect to the center of gravity is increased.

In addition, according to the this embodiment, the first toner layer L1 is formed by bringing the developing roller 5 and the removing/supply roller 13 into contact with each other with a peripheral speed difference and a potential difference to apply mechanical shear to the aggregate of both the positive and negative toners Tp and Tn and loosen the aggregate to separate the respective toners and form the first toner layer L1. Then, the second toner layer L2 is formed by forming the reservoir D of the mixed developer T immediately after forming the first toner layer L1. By adopting this constitution, the adhesive force of the first toner layer L1 and the developing roller 5 can be increased to be stronger than the adhesive force of the first toner layer L1 and the second toner layer L2. Thus, there is an effect that it is made easy to pass only the first toner layer L1 with the regulating blade 6 serving as single layer regulating means, and a separation performance by the regulating blade 6 is improved and an image failure such as color fog or unevenness of concentration can be prevented.

Further, according to this embodiment, since the outermost layer of the removing/supply roller 13 is formed as the foam (sponge layer) 13B, the space, which allows the respective positive and negative toners Tp and Tn to separate to the developing roller 5 side and the removing/supply roller 13 side, and the sufficient space, in which a residual toner consisting of the positively charged toner Tp after the separation and the toner scraped off from the developing roller 5 can be contained, can be formed. Thus, it becomes possible to provide the highly pure first toner layer L1 on the developing roller 5, and toner separation with less color mixing can be performed.

Moreover, at the time when a type of toner is switched, since the other type of toner to be buffered in the cell 13C of the foam (sponge layer) 13B is instantly supplied, high-speed switching of a type of toner becomes possible.

Figure 4:
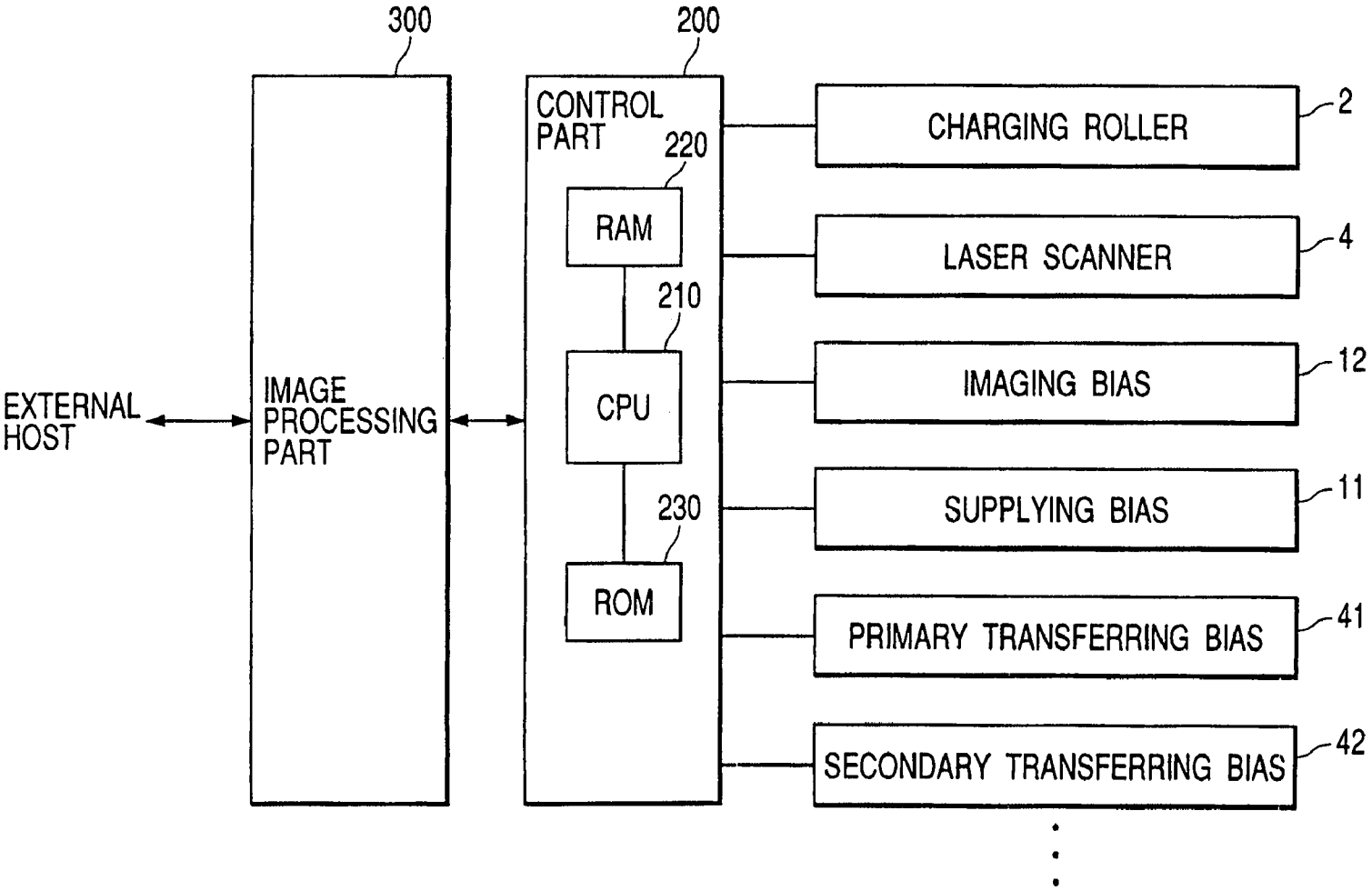
FIG. 4 is a schematic control block diagram for explaining a control form of the image forming apparatus of FIG. 1.

FIG. 4 shows a schematic control block of the image forming apparatus 100 of this embodiment. The image forming apparatus 100 has a control part 200 which includes a CPU 210 serving as a central element for control and causes the image forming apparatus 100 to operate sequentially in accordance with data, programs, and the like stored in a RAM 220 and a ROM 230. The control part 200 controls operations of the image forming apparatus 100 such as those of the charging roller 2, a laser scanner 4, the developing apparatus 7, the primary transferring roller 9, the corona charging part 19, the fixing device 24, and the recording material conveying means. The control part 200 also has a function of, as described above, switching a latent image forming operation in the respective stations Pa and Pb from an operation for regular development to an operation for reversal development at predetermined timing and, in association with this, switching a kind of toner to be supplied from the respective developing apparatuses 7*a* and 7*b*, a polarity of a primary transferring bias to be applied to the primary transferring roller 9, and a polarity of a bias to be applied to the corona charging part 19. In particular, the control part 200 has a function of, as described above, in order to switch a polarity of a potential difference between the developing roller 5 and the removing/supply roller 13 so as to change a kind of a toner to be supplied to the developing roller 5 of the developing apparatus 7 at predetermined timing, switching a bias to be applied to the removing/supply roller 13 from the supply bias power supply 11 serving as means for providing this potential difference.

An image processing part 300 is connected to the control part 200. The image processing part 300 receives an image signal from an external host apparatus such as a personal computer or an original reading apparatus, which are connected to the apparatus main body of the image forming apparatus 100 so as to be able to communicate with each other, and sends a signal for image formation to the control part 200. The control part 200 controls the operations of the respective parts of the image forming apparatus 100 in accordance with such an image forming signal.

Incidentally, a one kind of developer (toner) or a single kind of developer (toner) means a developer (toner) containing one kind of coloring agent, and does not means that the developer (toner) does not contain an additive for improving a charging polarity, charging aid, liquidity, and the like at all. In addition, a different coloring agent also includes one having the same tint and different concentration (density of a color).

The present invention will be hereinafter described more in detail citing concrete examples.

CONCRETE EXAMPLE 1

In this example, the developing apparatus 7 shown in FIG. 2 was used. As the mixed developer T contained in the developer container 8, a mixed developer, which used a nonmagnetic single component developer containing a black coloring agent (black toner) with an average particle diameter of 9 μm as the positively charged toner Tp and used a nonmagnetic single component developer containing a yellow coloring agent (yellow toner) with an average particle diameter of 8 μm as the negatively charged toner Tn, was used.

The developing roller 5 was an elastic roller with a diameter of 16 mm. The developing roller 5 was constituted by forming a conductive rubber 5B, which consisted of silicone rubber with a thickness of 4 mm and a resistivity of $10^5$ Ωcm, on an external periphery of a metal core 5A with a diameter of 8 mm (φ8) and applying a urethane coating 5C with a resistivity of $10^5$ Ωcm and a thickness of 30 μm to an outermost layer. Surface roughness of the developing roller 5 was 7 μm in Rz (JIS ten point height of irregularities: JISB0601) and hardness thereof was 45° (measured with Asker-C 1 kg load). The developing roller 5 is driven to rotate by driving means (not shown) and rotates in the direction of arrow in the figure at a peripheral speed of 160 mm/s. In addition, the developing roller 5 receives power supply from the developing bias power supply 12. In this example, a developing bias was set to a direct current −400 V.

The removing/supply roller 13 is constituted by forming the conductive rubber (sponge layer) 13B consisting of urethane foam with a thickness of 5 mm and a resistivity of $10^5$ Ωcm on the external periphery of the metal core 13A with a diameter of 4 mm (ϕ4). A foamed cell diameter of the urethane foam was 200 to 400 μm. Hardness of the removing/supply roller 13 was 20° (Asker-C 500 g load). The removing/supply roller 13 rotates in the direction of arrow in the figure at a peripheral speed of 125 mm/s in abutment against the developing roller 5. At this point, a center distance between the developing roller 5 and the removing/supply roller 13 was set to 14 mm such that the sponge layer 13B of the removing/supply roller 13 was compressed by 1 mm in the abutting part to generate an abutting pressure. In addition, the removing/supply roller 13 receives power supply from the supply bias power supply 13. In this example, a supply bias was set to be variable in a range of a direct current +200 V to −1,000 V, and the value was controlled according to a kind of a toner to be supplied.

Further, as the regulating blade 6, a stainless thin plate with a thickness of 200 μm was brought into the developing roller 5. One end side of the regulating blade 6 is fixed to the developer container 8 (fixed end), and the other end (free end) side is brought into abutment against the developing roller 5. A free length from the fixed end to the curved part (inflected part) 6A is 9 mm, and the tip of the regulating blade 6 has a curvature radius of 0.3 mm and is bent in a length of 2 mm. A position of the fixed end of the regulating blade 6 was adjusted such that the abutting pressure of the regulating blade 6 and the developing roller 5 was 25 gf/cm (≅0.245° N/cm) in a linear pressure. The regulating blade 6 was set to the same potential as the developing roller 5.

Figure 5:
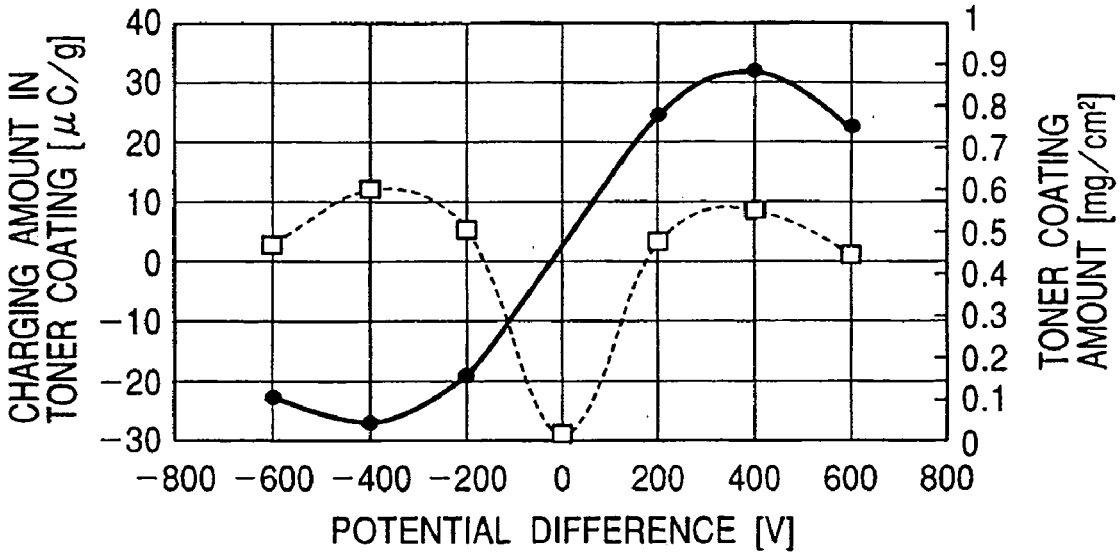
FIG. 5 is a graph showing a relation among a potential difference between the developing roller and the removing/supply roller, a toner coating amount, and a charging amount in toner coating.

FIG. 5 shows a result of, in the developing apparatus 7, sucking a toner on the developing roller 5 on the downstream side in the rotating direction of the developing roller 5 from the position where the developing roller 5 and the regulating blade 6 come into abutment against each other and measuring a toner coating amount on the developing roller 5 and a charging amount of a toner in the toner coat. The horizontal axis in the figure represents a potential difference between the developing-roller 5 and the removing/supply roller 13 (potential of the removing/supply roller 13—potential of the developing roller 5). Since a voltage of −400 V is applied to the developing roller 5, a voltage of −200 V on the horizontal axis indicates that a voltage of −600 V is applied to the removing/supply roller 13. In addition, a solid line in the figure represents a charging amount of a toner and follows the vertical axis on the left, and a dotted line represents a toner coating amount and follows the vertical axis on the right.

Note that, as a method of measuring a linear pressure, three thin plates having a known coefficient of friction and a width of 1 cm were stacked and inserted in the abutting part of the developing roller 5 and the regulating blade 6, only the thin plate in the center was pulled out by a spring balance, and a linear pressure was calculated from a pulling-out force at that point and the known coefficient of friction.

In addition, an average particle diameter of a toner was measured as a weight mean particle diameter as described below. The average particle diameter and a particle size distribution of a toner was measured as described below. First, an interface (manufactured by Nikkaki), which output a number distribution and a volume distribution, and a PC9801 personal computer (manufactured by NEC) are connected using a Coulter counter TA-II type or a Coulter multisizer (manufactured by Coulter). Next, a 1% NaCl water solution is prepared using first grade sodium chloride as an electrolyte. A surface active agent (preferably, alkyl benzene sulfonate) is added by 0.1 to 5 ml as a dispersing agent in the electrolyte of 100 to 150 ml, and a measurement sample is added by 2 to 20 mg. The electrolyte suspended with the sample was subjected to dispersion processing for about one to three minutes by an ultrasonic distributor, and a volume and the number of particles of the toner equal to or larger than 2 μm is measured by, for example, the Coulter counter TA-II using an aperture of 100 μm as an aperture to calculate the volume distribution and the number distribution. Then, a weight mean particle diameter of a weight reference found from the volume distribution was found as an average particle diameter of the toner.

Further, a charging amount of a toner was found as described below. A toner carried on the developing roller 5 was sucked and collected using a collection tool. A membrane filter is mounted to the collection tool, and a toner sucked with a suction force of 200 mm $H_2O$ is collected by the filter. An electrometer (model 617 manufactured by KEITHKEY) is connected to the collection tool to measure a total charging amount of the collected toner. A weight of the collected toner was measured by measuring an increase in weight of the filter, the total charging amount was divided by the weight of the collected toner, and an average charging amount per a unit weight of the toner was calculated as the charging amount of the toner.

From FIG. 5, it is seen that, when the potential difference is set to negative, the negatively charged toner (yellow toner) having the negative charging polarity is supplied to the developing roller 5 and, when the potential difference is set to positive, the positively charged toner (black toner) having the positive charging polarity is supplied to the developing roller 5.

On the other hand, when the potential difference is 0, the positive and the negative developers of the mixed developer T cohere, and the mixed developer T acts as if it is a pulverulent body with extremely little charging amount. The reflection force of the first toner layer L1 and the developing roller 5 does not work, and almost both the first and the second toner layers L1 and L2 are scraped off by the regulating blade 6. Thus, the toner coating amount is extremely reduced. Such a phenomenon is peculiar to the mixed developer T. This is a knowledge which cannot be obtained from the conventional developing apparatus using a single color developer.

If the potential difference is set to a small negative value (−200 V), a supply force is weak, a layer of the negatively charged toner Tn, which is formed as the first toner layer L1, is thin and has color mixing, and the black toner with a positive charging property is slightly mixed in the yellow toner of a negative charging property on the developing roller 5. In addition, if the potential difference is set to an excessively large negative value, not only the negatively charged toner Tn but also a toner with less charging amount or a toner slightly charged negatively of the positively charged toner Tp (called reversal toner) starts to mix in the first toner layer L and passes the regulating blade 6 to cause color mixing on the developing roller 5. Even in the case in which the potential difference is set to a positive value, behaviors of both the positive and negative toners Tp and Tn are reversed to cause the same phenomenon. This result is arranged in a table as shown below.

TABLE 1

| Potential difference between the developing roller and the removing/supply roller [V] | Toner coating color | Deposition amount (Bearing amount | Color mixing |
|---|---|---|---|
| −600 | Black is slightly mixed in yellow | ○ | × |
| −400 | Yellow | ○ | ○ |
| −200 | Black is slightly mixed in yellow | ○ | × |
| 0 | Toner amount is small | × | |
| 200 | Yellow is slightly mixed in black | ○ | × |
| 400 | Black | ○ | ○ |
| 600 | Yellow is slightly mixed in black | ○ | × |

In Table 1, the "deposition amount" is judged from the viewpoint of a coating amount of a toner sent to a developing part G (0.4 to 0.6 mg/cm$^2$) and a charging amount (15 μC/g or more in an absolute value), which are necessary when the toner is used for the developing apparatus 7, and ○ indicates a case in which both the amount of toner and the charging amount are sufficient, and x indicates a case in which both the amount of toner and the charging amount are insufficient. In addition, in table 1, the "mixing color" is a result of observing toner coating with a microscope and finding a color mixing rate of a toner from a rate of the numbers of toner particles of different colors, and ○ indicates a case in which the ratio of the numbers of particles is 9:1 (one kind of toner is 90%) or more, and x indicates a case in which the ratio of the numbers of particles is less than that. If one kind of toner is 90% or more, the problem of color fog, unevenness of concentration, or the like never occurs. In other words, in this specification, a toner mainly having one charging polarity or substantially one kind of toner, which is referred to concerning a toner on the developing roller 5, means that a ratio of the number of particles of a toner of one charging polarity or one kind of toner is 90% or more (the closer to 100%, the better).

In this example, when the negatively charged toner Tn was supplied, the potential difference was set to −400 V (the developing roller: −400 V), the removing/supply roller: −800 V) and, when the positively charged toner was supplied, the potential difference was set to +400 V (the developing roller: −400 V, the removing/supply roller: 0 V). As a result, color mixing was little for both the two colors, and a charging property was favorable.

In order to have little color mixing for both the two colors as described above, it is important to form the first toner layer (single color layer) L1, which consists of a sufficiently charged large amount of toner and the second toner layer (mixed developer layer) L2, which is formed on the first toner layer L1 with a weak adhesive force, and scrapes off the second toner layer L2 with the regulating blade 6.

Color mixing in the first toner layer L1 can be prevented by setting the potential difference between the developing roller 5 and the removing/supply roller 13 to a proper value. An optimal value of this potential difference varies depending upon a resistance value of the removing/supply roller 13. As a resistivity of the sponge layer 13B of the removing/supply roller 13, a resistivity of $10^1$ Ωcm to $10^8$ Ωcm can be preferably used, and an absolute value of the optimal potential different in that case is about 10 to 1,000 V.

As described above, if the potential difference is too small, a single color separation performance is low and color mixing occurs, and moreover, a toner coating amount decreases. In addition, if the potential difference is too large, color mixing due to reversal toner components is caused. If a resistivity of the removing/supply roller 13 is smaller than $10^1$ Ωcm, leak of a toner is caused locally in the abutting part of the removing/supply roller 13 and the developing roller 5, and unevenness of supply and color mixing occur. Further, if the resistivity is larger than $10^8$ Ωcm, a supply amount decreases, and a sufficient toner coating amount cannot be obtained.

Figure 6:
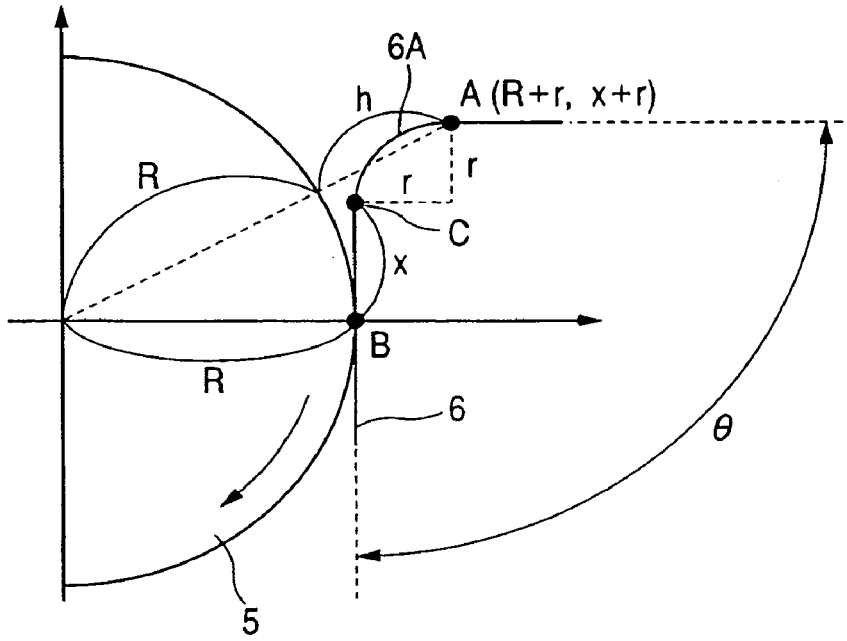
FIG. 6 is an explanatory diagram for explaining removal by a regulating blade.

Moreover, it is important to remove substantially the entire second toner layer L2 with the regulating blade 6 in preventing color mixing. FIG. 6 shows a diagram (diagram viewed from the back of the paper surfaces of FIGS. 2 and 3) illustrating removal by the regulating blade 6. In FIG. 6, a semicircle with a radius R indicates the developing roller 5, which rotates in a direction of arrow in the figure. In other words, reference character R denotes a radius of the developing roller 5. The curved part (inflected part) 6A with a curvature radius r is provided in the vicinity of the tip of the regulating blade 6. An abutting part (nip part) of the regulating blade 6 and the developing roller 5 is represented by a point B, and a length of a segment BC from the point B to a point (start point) C before the curved part 6A (length from the nip to the end: NE length) is x. A point A is an end point of the curved part 6A when the curve of the regulating blade 6 is 90°. Further, a distance h from the point A to the developing roller 5 is defined as a taking-in height of the regulating blade 6. A portion from the curved part 6A to the abutting part B substantially constitutes a layer regulating part which allows passage of the first toner layer L1 following movement of the surface of the developing roller 5 and regulates passage of the second toner layer L2.

The first and the second toner layers L1 and L2 on the developing roller 5 are regulated by the regulating blade 6 and scraped off from the outermost layer. However, it is difficult to measure and cannot be said indiscriminately to which height in FIG. 6 the first and the second toner layers L1 and L2 are scraped off. In an experimental result of the inventor, in order to obtain a sufficient separation performance of the regulating blade 6, the taking-in height h was required to be at least 550 μm or less.

Figure 7:
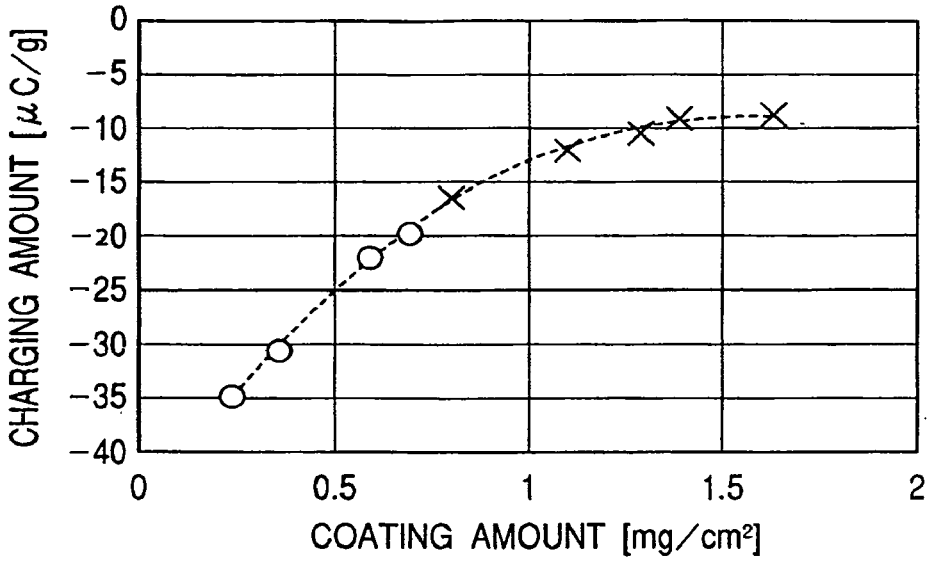
FIG. 7 is a graph showing a relation between a toner coating amount and a charging amount in toner coating.

FIG. 7 shows a relation between a toner coating amount and a charging amount of a toner in toner coating at the time when the regulating blades 6 having several different kinds of the NE length x and the curvature radius r in the figure were prepared, the regulating blades 6 were mounted to the developing apparatus 7 of this example, and the potential difference of the developing roller 5 and the removing/supply roller 13 was set to −400 V.

From FIG. 7, it is seen that the charging amount is large if the toner coating amount is small, the charging amount is small if the toner coating amount is large, and only a toner having a strong reflection force with respect to the developing roller 5 can pass if the regulation by the regulating blade 6 is tightened. In FIG. 7, points marked with an x indicate a case in which color mixing has occurred. In addition, points marked with an ○ indicate a case in which a ratio of the numbers of particles of different colors is 9:1 (90%) or more, and the points marked with an x indicate a case in which the ratio is lower than that. As the taking-in height h became smaller, the toner coating amount decreased and, as the taking-in height h became larger, the toner coating amount increased.

Further, the taking-in height h at the time when the toner coating amount was the largest and the problem of color mixing did not occur was 550 μm. If the taking-in height h is further reduced, although the problem of color mixing never occurs, the toner coating amount decreases and a problem of low concentration occurs. Thus, the toner coating amount is preferably about 0.3 to 0.6 mg/cm$^2$. Since the toner coating amount was 0.37 mg/cm$^2$ even if the taking-in height h is reduced to 0, the taking-in height h only has to be 550 μm or less. Therefore, in the case in which it is assumed that the radius of the developing roller 5 is R, the curvature radius of the curved part 6A is r (including 0), and the NE length is x, the taking-in height h is represented by formula shown below.

$$h=\sqrt{(R+r)^2+(x+r)^2}-R\leqq 550\ \mu m \quad (1)$$

It was confirmed that the above-described conditions may generally apply if R>10r at a bending angle θ of 0° to 135° if not 90°. In addition, when the bending angle θ is 135° or more, it is sufficient to set the curvature radius r to 0.

Figure 8:
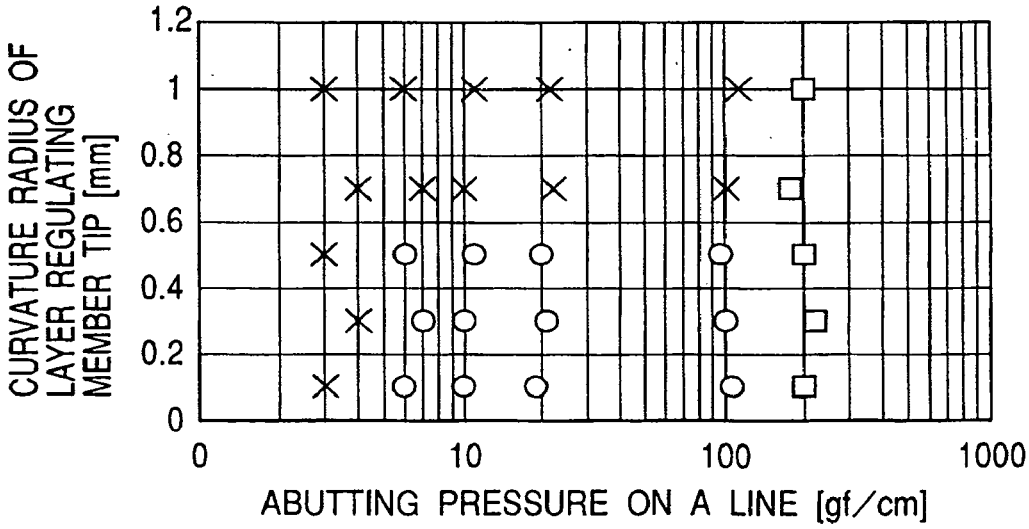
FIG. 8 is a graph showing a relation between an abutting pressure of the regulating blade and a curvature radius at the tip of the regulating blade.

FIG. 8 shows a state of color mixing at the time when the NE length x was set to 0, the curvature radius r was changed to 0.1 mm, 0.3 mm, 0.5 mm, 0.7 mm, and 1 mm, and a linear pressure of abutment against the developing roller 5 was changed.

Note that, a method of measuring the linear pressure of abutment is the same as the above description, three thin plates having a known coefficient of friction and a width of 1 cm were stacked and inserted in the abutting part of the developing roller 5 and the regulating blade 6, only the thin plate in the center was pulled out by a spring balance, and a linear pressure was calculated from a pulling-out force at that point and the known coefficient of friction.

A result of FIG. 8 was obtained as described below. After continuously operating the developing apparatus 7 for ten hours switching the potential difference between the developing roller 5 and the removing/supply roller 13 to −400 V and +400 V every ten seconds, a state of color mixing of the developing roller 5 was observed by a microscope in the respective cases in which the potential difference was −400 V, 0V and +400 V. In FIG. 8, points marked with an x indicate a case in which color mixing has occurred. In addition, points marked with an ○ indicate a case in which the ratio of the numbers of particles of the negatively charged toner Tn and the positively charged toner Tp is 9:1 (90%) or more at the time when the potential difference is −400 V and the ratio of the numbers of particles of the negatively charged toner Tn and the positively charged toner Tp is 9:1 (90%) or more at the time when the potential difference is +400 V, and the points marked x indicate a case in which the number of the particles is 90% or less at any potential difference. Further, in FIG. 8, points marked with an □ indicate a case in which fusion bond of the toner is observed on the developing roller 5 at the time when the potential difference is 0. If the toner is fused and bonded to the developing roller 5, unpreferably, deterioration of a developing performance or image streak is generated.

From FIG. 8, it is seen that, if the curvature radius r of the curved part 6A at the tip of the regulating blade 6 is 0.5 mm or less and the linear pressure of abutment of the regulating blade 6 is 5 to 100 gf/cm (≅0.049 to 0.98 N/cm), the problem of color mixing of both the two colors never occurs, and a favorable separation performance can be obtained. If the linear pressure of abutment of the regulating blade 6 is smaller than 5 gf/cm, a regulating force is insufficient and color mixing occurs. In addition, the linear pressure of abutment of the regulating blade 6 is larger than 100 gf/cm, although a problem never occurs with the supply of a single color of toner, a toner is fused and bonded to the developing roller 5 if the regulating blade 6 is used while switching colors of toners. This is considered to be caused because, when the potential difference between the developing roller 5 and the removing/supply roller 13 is changed from −400 V to +400 V in order to change a color of a toner to be coated on the developing roller 5, since the toner coating amount temporarily decreases and the toner working as a lubricant decreases, friction of the developing roller 5 and the regulating blade 6 increases to facilitate fusion bond of the toner to the developing roller 5.

In this way, in the case in which it is assumed that the radius of the developing roller 5 is R, the curvature radius of the curved part (inflected part) 6A of the regulating blade 6 serving as single layer regulating means is r, and the NE length, which is a distance from the abutting part of the developing roller 5 and the regulating blade 6 to the front of the curved part 6A, is x, preferably, by satisfying a relation of formula 2, the second toner layer (mixed developer layer) L2 can be scraped off, color mixing can be prevented, and the color separation ability can be improved.

$$\sqrt{(R+r)^2+(x+r)^2}-R\leqq 550\ \mu m \quad (2)$$

In addition, the regulating blade 6 serving as single layer regulating means has the curbed part 6A and comes into abutment against the developing roller 5 in the vicinity of the curved part 6A and, preferably, the curvature radius r of the curved part 6A is set to 0.5 mm or less and the abutting pressure of the regulating blade 6 and the developing roller 5 is set to 5 gf/cm or more and 100 gf/cm or less. As a result, the second toner layer (mixed developer layer) L2 can be scraped off, color mixing can be prevented, the color separation ability can be improved, and fusion bond of a developer to the developing roller 5, which occurs when color switching is performed continuously, can be prevented.

In the above description, the case in which a DC bias is applied to the developing roller 5 is described. However, even if an alternating current is superimposed on a developing bias or a bias to be applied to the removing/supply roller 13, the same effect can be obtained if a potential difference is provided between the developing roller 5 and the removing/supply roller 13 in time average.

As described above, according to this embodiment, plural kinds of toners can be selectively furnished for development with one developing apparatus 7, and it is possible to reduce occurrence of image failure such as fog on a formed image, muddled color, and the like and improve a degree of freedom of apparatus design. Consequently, in a full-color image forming apparatus, the number of developing apparatuses 7 can be reduced from four, which is the conventionally required number, to two.

In order to further clarify the effects of the invention, several comparative examples will be hereinafter described.

COMPARATIVE EXAMPLE 1

Figure 11A:
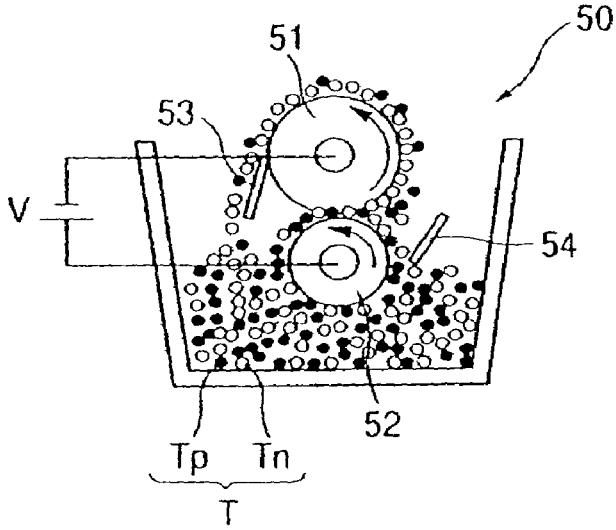
FIG. 11A PRIOR ART
FIGS. 11A and 11B are schematic sectional views of an example of a conventional developing apparatus.
Figure 11B:
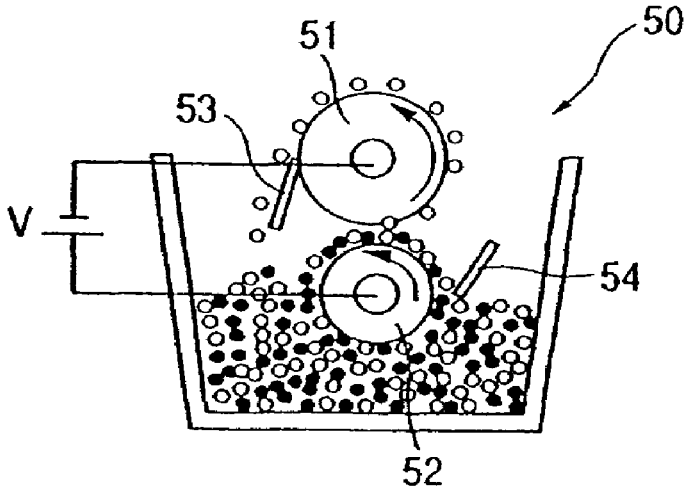
FIG. 11B PRIOR ART

FIGS. 11A and 11B show the constitution, which is disclosed in Japanese Patent Publication No. H2-37595, as a comparative example 1.

A developing apparatus 50 shown in FIGS. 11A and 11B uses a mixed developer T in which a nonmagnetic single component developer with a positive charging property (positively charged toner) Tp and a nonmagnetic single component developer with a negative charging property (negatively charged toner) Tn. The developing apparatus 50 has a developing roller 51 and rotates in a direction of arrow in the figure. A removing blade 53 is arranged in abutment against the developing roller 51 and scrapes off a residual toner on the developing roller 51. In addition, a supply roller 52, which supplies a toner to the developing roller 51, and a regulating blade 54, which regulates an amount of toner on the supply roller 52 and triboelectrically charges the toner on the supply roller 52, are provided. Further, a potential difference V is provided between the developing roller 51 and the supply roller 52, and a value of the potential difference V is 100 to 1,000 V. FIG. 11A shows a case in which the developing roller 51 and the supply roller 52 are in contact with each other, and FIG. 11B shows a case in which the developing roller 51 and the supply roller 52 are not in contact with each other.

With the constitution of FIG. 11A, a toner of one polarity moves to the developing roller 51 according to the potential difference, and a toner of the other polarity moves to the supply roller 52 side. However, a space in which the toners can move is extremely small, the toners cannot move smoothly, and colors cannot be separated completely. Thus, color mixing occurs on the developing roller 51. Consequently, unevenness of concentration and color fog occur. In addition, since a space in which the toners can move is also extremely small when a polarity of the potential difference is switched, the developing roller 51 is required to rotate several times until a color of a toner to be coated on the developing roller 51 is switched. Thus, this constitution is not practical.

With the constitution of FIG. 11B, since only a toner of one-polarity flies from the supply roller 52 and deposits on the developing roller 51, the problem of color mixing can be reduced. However, since a mixed developer on the supply roller 52 is charged only by the regulating blade 54 which is brought into abutment against the supply roller 52, a distribution of charging amounts is broad, and the toner flying from the supply roller 52 is not uniform and tends to be uneven on the developing roller 51.

Therefore, Japanese Patent Publication No. H2-37595 recommends a constitution which, in the constitution of FIG. 11B, uses a magnetic developer and the supply roller 52 containing a magnet to cause the developer to fly from the supply roller 52 to the developing roller 51 uniformly under an alternating electric field.

However, a magnetic developer with high color development property is not obtained at the present point, and there is an essential problem in that a range of color reproduction of full color is narrow.

Moreover, with the constitution of FIG. 11B, it is necessary to control an amount of developer which prevents the mixed developer T from coming into contact with the developing roller 51 in order to prevent color mixing and, unless a sufficient amount of developer is maintained in the vicinity of the supply roller 52, a supply amount decreases to cause low concentration. Consequently, it is necessary to arrange the developing roller 51 above in the direction of the gravity with respect to the supply roller 52 and it is also necessary to adjust an amount of developer such that the supply roller 52 is always immersed in the mixed developer T. Thus, there is a problem in that the apparatus is complicated and a degree of freedom of design is low.

COMPARATIVE EXAMPLE 2

Figure 12:
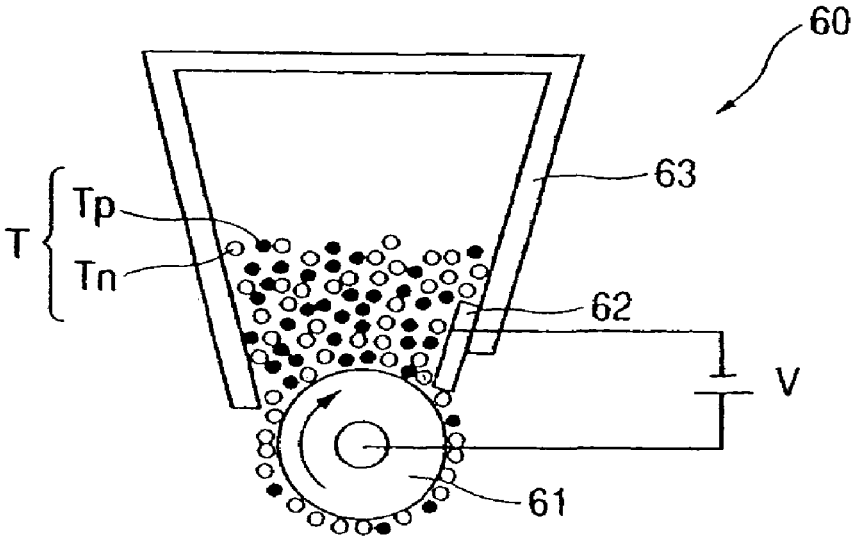
FIG. 12 PRIOR ART
FIG. 12 is a schematic sectional view of another example of the conventional developing apparatus.

FIG. 12 shows the constitution, which is disclosed in Japanese Patent Application Laid-Open No. S55-43533, as a comparative example 2.

In a developing apparatus 60 shown in FIG. 12, a mixed developer T consisting of a nonmagnetic single component developer with a positive charging property (positively charged toner) Tp and a nonmagnetic single component developer with a negative charging property (negatively charged toner) Tn is contained in a hopper 63. An upper surface of a developing roller 61 is adjacent to a lower opening of the hopper 63. The developing roller 61 is constituted by coating conductive elastic rubber on a cored bar. A doctor 62 is provided on a side wall of the hopper 63 on the downstream side in a direction of movement of the upper surface of the developing roller 61, and a tip of the doctor 62 is adjacent to the surface of the developing roller 61 at a predetermined interval. The doctor 62 is electrically conductive, and an order in triboelectrification series is the same as that of one toner or in the middle of those of both the toners. In addition, a potential difference V is provided between the doctor 62 and the developing roller 61. A polarity of the potential difference V can be changed to both positive and negative by a variable power supply. The doctor 62 regulates amounts of toners of two colors, which are supplied to the surface of the developing roller 61 from the hopper 63 and performs charging by friction against the toners of two colors and charging by charge injection simultaneously.

When the potential difference V is set to a positive potential difference, although the negatively charged toner Tn is supplied to the developing roller 61, at the same time, a part of the positively charged toner Tp is subjected to charge injection and charged to negative. Consequently, the positively charged toner Tp is furnished for development simultaneously with the negatively charged toner Tn to cause color mixing in a developed image. In addition, since the positively charged toner Tp is furnished for development passing through the doctor 62, color fog and unevenness of concentration occur.

OTHER EMBODIMENTS

In the above-described embodiment, the case in which the curved part 6A is provided on the tip side of the regulating plate 6 is described as an example. However, the same single layer regulating effect is realized by other blade forms. FIGS. 9A, 9B, 9C and 9D show other forms of the regulating blade 6. Note that, in FIGS. 9A, 9B, 9C and 9D, the removing/supply roller 13, the developer container 8, and the like are omitted, and only the vicinity of the regulating blade 6 and the developing roller 5 is illustrated.

Figure 9A:
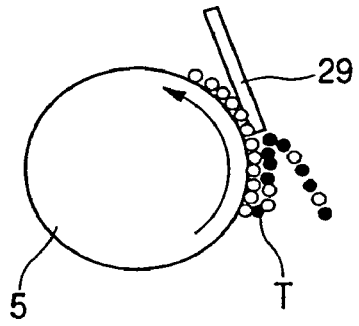
FIGS. 9A, 9B, 9C and 9D are schematic diagrams for explaining another embodiment of toner amount regulating means.

FIG. 9A shows a constitution for scraping off a toner on the developing roller 5 with a regulating blade of a plate shape (plate-like blade) 29 which does not have the curved part 6A at the tip thereof. The taking-in height h of the plate-like blade 29 can perform single layer regulation with the above-described conditions (formula 1) in the case in which the curvature radius r is set to 0. Although the single color separation effect can be obtained with a simple constitution, the developing roller 5 may be damaged to cause a streak image if the tip of the plate-like blade 29 and the developing roller 5 come into abutment against each other. Thus, in the case in which the plate-like blade 29 is made of a rigid body, it is preferable to use the plate-like blade 29 in a range of $x>0$ concerning the NE length x or to use a blade of an elastic body such as urethane or silicone.

Figure 9B:
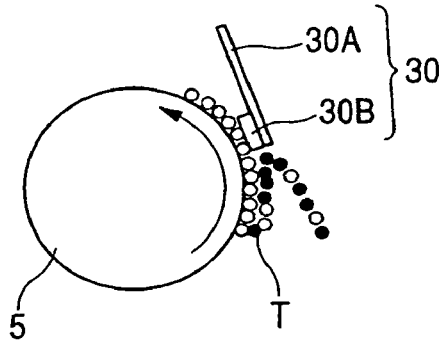

FIG. 9B shows a constitution for supplementing a drawback of the plate-like blade 29. This is a regulating blade (chip blade) 30 which has a chip member 30B, which consists of an elastic body such as urethane or silicone, adhered thereto or formed integrally therewith at least on the surface side of the developing roller 5 of a tip of a metal plate blade 30A. With this chip blade constitution, a streak image is not generated even if the NE length x is set to 0, and a high single color separation effect can be obtained. Moreover, since a Young's modulus of the metal plate blade 30A (plate member) is high, an abutting pressure can be increased compared with a blade consisting only of an elastic body, and a degree of freedom of setting of the abutting pressure is high.

Figure 9C:
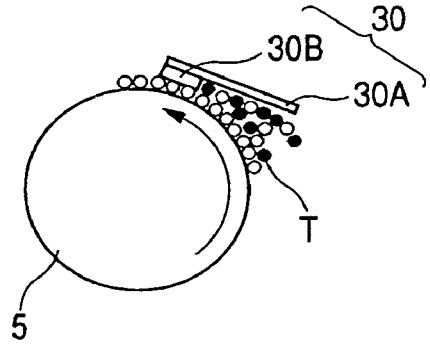

FIG. 9C shows a constitution in which a fixed end of a regulating blade (chip blade 30 in the illustrated example) is further on the upstream side in the direction of rotation of the developing roller 5 than the abutting part. Compared with the constitution of FIG. 9B, this constitution has an advantage that a removing part of a mixed developer layer can be made more compact. However, since the scraped-off mixed developer T accumulates easily in the case in which the curvature radius of the developing roller 5 is large, this is a single layer regulating method which is preferable in the case in which the curvature radius of the developing roller 5 is small.

Figure 9D:
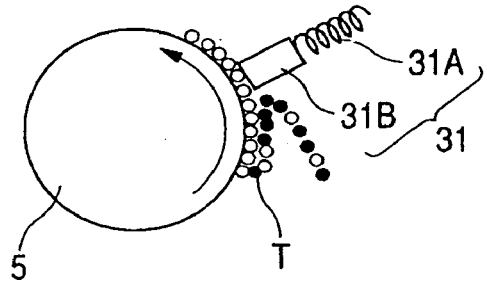

FIG. 9D shows a constitution for supplementing a drawback of the regulating blade shown in FIG. 9C. A regulating member 31B of a quadric prism shape is pressed by the developing roller 5 by a spring 31A as an elastic body to constitute regulating means 31. There is an advantage that a single layer regulating part can be made relatively compact and the scraped-off mixed developer T does not accumulate easily regardless of the diameter of the developing roller 5.

In addition, the present invention is likewise applicable to a case in which a developing apparatus is constituted as a cartridge which is detachably mountable to an image forming apparatus main body individually or integrally with other members. In this case, the cartridge is detachably mounted to the image forming apparatus main body via mounting means provided in the image forming apparatus main body.

For example, FIG. 10 shows a process cartridge 26 in which an electrophotographic photosensitive member 1 and developing means 7, charging means 2 and cleaning means 10, which serve as process means acting on this electrophotographic photosensitive member 1, are integrally constituted by a frame 25, and are detachably mountable to the image forming apparatus main body. The process cartridge 26 is detachably mounted to the image forming apparatus main body via mounting means 27 such as a mounting guide and positioning means provided in the image forming apparatus main body. According to a process cartridge system, for example, when a toner has been consumed, a durable life of the photosensitive drum 1 has been fulfilled, or the waste toner 16 has filled the cleaner container 14, since a user can perform maintenance of the apparatus by himself/herself without depending upon a serviceperson, operability can be improved remarkably.

When the process cartridge 26 is mounted to the apparatus main body normally, driving means provided in the apparatus main body and driving force transmitting means such as a gear transmitting a driving force to the photosensitive drum 1 are coupled with each other, and the photosensitive drum 1 comes into a drivable state. Moreover, this driving force is transmitted to the developing roller 5, the removing/supply roller 13, and the agitating member 15. In addition, when the process cartridge 26 is mounted to the apparatus main body, a developing bias contact on the apparatus main body side 11A and a supply bias contact on the apparatus main body side 12A, which are provided on the apparatus main body side as contact parts for power supply to the developing roller 5 and the removing/supply roller 13, are electrically connected to a developing bias contact on the cartridge side 11B and a supply bias contact on the cartridge side 12B, which are provided on the process cartridge 26 side, respectively. Consequently, it becomes possible to apply a bias to the developing roller 5 and the removing/supply roller 13 from the developing bias power supply 11 and the supply bias power supply 12, which are provided in the apparatus main body, respectively, via these contact parts.

The process cartridge 26 is not limited to the illustrated form, and one or both of the cleaning means 10 and the charging means 2 may not be provided. Usually, in a process cartridge, an electrophotographic photosensitive member and at least one of charging means, developing means and cleaning means, which serve as process means acting on the electrophotographic photosensitive member, are integrally formed as a cartridge, and this cartridge is made detachably mountable to the apparatus main body. However, the present invention can be applied preferably to any process cartridge as long as at least an electrophotographic photosensitive member and developing means, which has a developer container containing a developer, a developer carrying member carrying the developer in the developer container to an object to be developed, multi-layer forming means, and single layer regulating means, are integrally formed as a cartridge, and this cartridge is made detachably mountable to the apparatus main body.

A cartridge in which a developing apparatus is detachably mountable to an image forming apparatus main body individually (development cartridge) is equivalent to a cartridge obtained by removing the electrophotographic photosensitive member 1, the charging means 2, and the cleaning means 10 from the process cartridge shown in FIG. 10.

In this way, in the case in which the developing apparatus is detachably mountable to the image forming apparatus main body as the cartridge (the development cartridge or the process cartridge), according to the present invention, since one developing apparatus can replace the conventional developing apparatuses for two colors, it becomes possible to simplify maintenance.

In addition, although the image forming apparatus is described as having the intermediate transferring member as a member to have a developer image transferred thereon from the image bearing member, the present invention is not limited to this. The present invention is likewise applicable to an image forming apparatus which has, instead of the intermediate transferring member, a recording material carrying member for carrying a recording material such as recording paper to repeatedly convey the recording material to a part opposed to the image bearing member and transferring developer images consisting of plural kinds of developers onto the recording material one after another. Moreover, the present invention is also applicable to an image forming apparatus which is provided with single or plural developing apparatuses in accordance with the present invention for a single image bearing member, forms developer images of plural colors on the image bearing member one after another with the single or plural developing apparatuses, and transfers the developer images onto the recording material to the intermediate transferring member or the recording material carrying member to obtain a composite image.

According to the developing apparatus of the present invention; plural kinds of developers can be selectively furnished for development, color mixing can be prevented and occurrence of an image failure such as muddled color, color fog or unevenness of concentration can be prevented, and a degree of freedom of apparatus design can be improved. According to the developing apparatus of the present invention, it becomes possible to reduce the number of developing apparatuses from four, which is the conventionally required number, to two in a full-color image forming apparatus. In addition, according to the present invention, an image forming apparatus, which is provided with such a developing apparatus of the present invention and can show corresponding operational effects, is provided.

What is claimed is:

1. A developing apparatus comprising:

a developer container which contains a first developer provided with a first charging polarity and a second developer provided with a second charging polarity opposite to the first charging polarity;

a developer bearing member which bears the first and the second developers;

layer forming means which forms a first layer substantially including the first developer, on the developer bearing member and forms a second layer including the first and the second developers, on the first layer; and separating means which is provided on a downstream side of the layer forming means and on an upstream side of a developing position in a developer carrying and conveying direction of the developer bearing member and separates the second layer from the developer bearing member.

2. A developing apparatus according to claim 1, wherein the separating means allows passage of the first layer and regulates passage of the second layer.

3. A developing apparatus according to claim 1, wherein the separating means is a regulating member which is pressed by the developer bearing member and regulates thickness of the first layer on the developer carrying member.

4. A developing apparatus according to claim 3, wherein, in the case in which it is assumed that a radius of the developer bearing member is R, a curvature radius of an inflected part formed in a developer layer thickness regulating part of the regulating member is r, and an NE length, which is a distance from a contacting part of the developer bearing member and the regulating member to the inflected part, is x, $$\sqrt{(R+r)^2+(x+r)^2}-R \leqq 550\ \mu m$$

is satisfied.

5. A developing apparatus according to claim 3 or 4, wherein the curvature radius of the inflected part is 0.5 mm or less and a contacting pressure of the regulating member and the developer bearing member is 5 gf/cm or more and 100 gf/cm or less.

6. A developing apparatus according to claim 1, wherein a color of the first developer and a color of the second developer are different.

7. A developing apparatus according to claim 1, wherein, when the first layer and the second layer are formed on the developer bearing member, a potential difference is provided between the layer forming means and the developer bearing member.

8. A developing apparatus according to claim 7, wherein, when the first layer and the second layer are formed on the developer bearing member, a polarity of a potential, which is obtained by deducting a potential of the developer bearing member from a potential of the layer forming means, is the same as the first charging polarity.

9. A developing apparatus according to claim 7, wherein a polarity of the potential difference is switched, whereby the layer forming means forms a third layer, which substantially includes the second developer, on the developer bearing member and forms a fourth layer, which includes the first and the second developers, on the third layer.

10. A developing apparatus according to claim 9, wherein the separating means separates the fourth layer from the developer bearing member.

11. A developing apparatus according to claim 1, wherein the layer forming means is a rotary member which is rotatable in contact with the developer bearing member, and the rotary member carries the first and the second developers on a surface thereof and rotates with a peripheral speed difference with respect to the surface of the developer bearing member.

12. A developing apparatus according to claim 11, wherein the rotary member includes a surface layer of a foam having conductivity and contains the first and the second developers in vacancies of the foam.

13. A developing apparatus according to any one of claims 1 to 3, wherein the separating means is one of a rigid body and an elastic body which is brought into abutment against the developer bearing member.

14. A developing apparatus according to claim 1, wherein the developing apparatus is detachably mountable to an image forming apparatus main body.

15. A developing apparatus according to claim 1, wherein the developing apparatus is provided in a process cartridge together with an image bearing member on which a developer image is formed by the developing apparatus, and the process cartridge is detachably mountable to an image forming apparatus main body.

16. A developing apparatus comprising:

a developer container which contains a first developer provided with a first charging polarity and a second developer provided with a second charging polarity opposite to the first charging polarity;

a developer bearing member which bears the first and the second developers;

layer forming means which forms a first layer, which substantially includes the first developer, on the developer bearing member and forms a second layer, which includes the first and the second developers, on the first layer; and a regulating member which is provided on a downstream side of the layer forming means and on an upstream side of a developing position in a developer bearing and conveying direction of the developer bearing member and regulates thickness of a layer of a developer on the developer bearing member, the regulating member including an inflected part in a developer regulating part, wherein a curvature radius of the inflected part is 0.5 mm or less, and a contacting pressure of the regulating member and the developer bearing member is 5 gf/cm or more and 100 gf/cm or less.

17. A developing apparatus according to claim 16, wherein a color of the first developer and a color of the second developer are different.

18. A developing apparatus according to claim 16, wherein, when the first layer and the second layer are formed on the developer bearing member, a potential difference is provided between the layer forming means and the developer bearing member.

19. A developing apparatus according to claim 18, wherein, when the first layer and the second layer are formed on the developer bearing member, a polarity of a potential, which is obtained by deducting a potential of the developer bearing member from a potential of the layer forming means, is the same as the first charging polarity.

20. A developing apparatus according to claim 18, wherein a polarity of the potential difference is switched, whereby the layer forming means forms a third layer, which substantially includes the second developer, on the developer bearing member and forms a fourth layer, which includes the first and the second developers, on the third layer.

21. A developing apparatus according to claim 16, wherein the layer forming means is a rotary member which is rotatable in contact with the developer bearing member, and the rotary member carries the first and the second developers on a surface thereof and rotates with a peripheral speed difference with respect to the surface of the developer bearing member.

22. A developing apparatus according to claim 21, wherein the rotary member includes a surface layer of a foam having conductivity and contains the first and the second developers in vacancies of the foam.

23. A developing apparatus according to claim 16, wherein the regulating means is one of a rigid body and an elastic body which is brought into abutment against the developer bearing member.

24. A developing apparatus according to claim 16, wherein, in the case in which it is assumed that a radius of the developer bearing member is R, a curvature radius of the inflected part is r, and an NE length, which is a distance from a contacting part of the developer bearing member and the regulating member to the inflected part, is x, $$\sqrt{(R+r)^2+(x+r)^2}-R<550\ \mu m$$

is satisfied.

25. A developing apparatus according to claim 16, wherein the developing apparatus is detachably mountable to an image forming apparatus main body.

26. A developing apparatus according to claim 16, wherein the developing apparatus is provided in a process cartridge together with an image bearing member on which a developer image is formed by the developing apparatus, and the process cartridge is detachably mountable to an image forming apparatus main body.

27. An image forming apparatus comprising:

a plurality of developing apparatuses, each of the plurality of developing apparatuses comprising:

a developer container which contains a first developer of a first color provided with a first charging polarity and a second developer of a second color provided with a second charging polarity opposite to the first charging polarity;

a developer bearing member which bears the first and the second developers;

layer forming means which forms a first layer, which substantially includes the first developer, on the developer bearing member and forms a second layer, which includes the first and the second developers, on the first layer; and separating means which is provided on a downstream side of the layer forming means and on an upstream side of a developing position in a developer carrying and conveying direction of the developer bearing member and separates the second layer from the developer carrying member.

28. An image forming apparatus according to claim 27, wherein a developer image of four colors is formed on a member to be transferred thereon using the plurality of developing apparatuses.

29. An image forming apparatus according to claim 27, further comprising a plurality of image bearing members corresponding to the plurality of developing apparatuses, two kinds of developer images of different colors are formed on any one of the plurality of image bearing members by any one of the plurality of developing apparatuses, two kinds of developer images of different colors are formed on another of the plurality of image bearing members by another of the plurality of developing apparatuses, and a developer image of four colors is formed on a member to be transferred thereon.

30. An image forming apparatus according to claim 28 or 29, further comprising the member to be transferred thereon, which is an intermediate transferring member, and the image forming apparatus further includes charging means which adjusts a charging polarity of a developer on the intermediate transferring member.

31. An image forming apparatus according to claim 30, wherein the charging means also functions as transferring means which transfers a developer image from the intermediate transferring member onto a recording material.

* * * * *

UNITED STATES PATENT AND TRADEMARK OFFICE

CERTIFICATE OF CORRECTION

PATENT NO. : 7,068,967 B2
APPLICATION NO. : 10/765855
DATED : June 27, 2006
INVENTOR(S) : Ken Nakagawa It is certified that error appears in the above-identified patent and that said Letters Patent is hereby corrected as shown below:

COLUMN 1:
Line 46, “resulted” should read --resulting--.

COLUMN 2:
Line 57, “Patent.” should read --Patent--.

COLUMN 8:
Line 16, “conveys” should read --conveying--.

COLUMN 9:
Line 50, “other-by” should read --other by--.

COLUMN 22:
Line 6, “invention;” should read --invention,--.

Signed and Sealed this

Ninth Day of January, 2007

JON W. DUDAS
*Director of the United States Patent and Trademark Office*